US006917274B2

(12) United States Patent
Hong et al.

(10) Patent No.: US 6,917,274 B2
(45) Date of Patent: Jul. 12, 2005

(54) STACKED COIL DEVICE AND FABRICATION METHOD THEREOF

(75) Inventors: Soon-Gyu Hong, Gyeonggi-Do (KR); Myoung-Hui Choi, Seoul (KR); Sang-Eun Jang, Gyeongi-Do (KR)

(73) Assignee: Ceratech Corporation (KR)

( * ) Notice: Subject to any disclaimer, the term of this patent is extended or adjusted under 35 U.S.C. 154(b) by 0 days.

(21) Appl. No.: 10/676,206

(22) Filed: Oct. 1, 2003

(65) Prior Publication Data

US 2004/0061587 A1 Apr. 1, 2004

(30) Foreign Application Priority Data

Oct. 1, 2002 (KR) ..... 10-2002-0059899

(51) Int. Cl.[7] ..... H01F 5/00

(52) U.S. Cl. ..... 336/200; 336/223; 336/232; 29/602.1

(58) Field of Search ..... 336/200, 223, 336/232; 29/602.1, 606

(56) References Cited

U.S. PATENT DOCUMENTS 6,293,001 B1 * 9/2001 Uriu et al. ..... 29/608
6,362,947 B1 * 3/2002 Chazono ..... 361/306.3
6,388,551 B2 * 5/2002 Morikawa ..... 336/223
6,710,694 B2 * 3/2004 Matsuta et al. ..... 336/200

FOREIGN PATENT DOCUMENTS

| | | |
|---|---|---|
| JP | 7-201569 | 8/1995 |
| JP | 8-37108 | 2/1996 |
| JP | 09-260145 | * 3/1997 |
| JP | 2001-76930 | 3/2001 |

* cited by examiner

*Primary Examiner*—Lincoln Donovan
*Assistant Examiner*—Jennifer A. Poker
(74) *Attorney, Agent, or Firm*—Ostrolenk, Faber, Gerb & Soffen, LLP

(57) ABSTRACT

A stacked coil device comprising: an inner electrode layer formed of at least two parts and having a non-magnetic electrode region and an inner magnetic region formed as one layer, the non-magnetic electrode region being provided with an opening at a center thereof and provided with an electrode pattern on at least one surface of an upper surface and a lower surface thereof and the inner magnetic region positioned at the center opening and a lateral surface of the non-magnetic electrode region; a cover layer in contact with both surfaces of the inner electrode layer; and an external electrode terminal electrically connected to the electrode pattern.

10 Claims, 10 Drawing Sheets

STACKED COIL DEVICE AND FABRICATION METHOD THEREOF

BACKGROUND OF THE INVENTION

1. Field of the Invention

The present invention relates to a stacked coil device, and more particularly, to a coil device capable of being used as a transformer, a common mode choke coil, and etc.

2. Description of the Conventional Art

Generally, it is important to increase an electromagnetic coupling between a first coil and a second coil in order to enhance an electrical characteristic of a coil device such as a common mode choke coil or a transformer. To increase the electromagnetic coupling between the first and second coils, an interval between the first and second coils has to be small or a magnetic path has to be formed not to generate a leakage flux.

FIG. 1A is a perspective view showing a common mode choke coil including a coil device in accordance with the conventional art, and FIG. 1B is a disassembled view of the common mode choke coil of FIG. 1.

As shown in FIG. 1A, the common mode choke coil 1 includes a stack body 7 formed at an upper portion of a first magnetic substrate 3, a second magnetic substrate 10 formed at an upper portion of the stack body 7, an adhesive layer 8 formed between the stack body 7 and the second magnetic substrate 10, and an external electrode 11 formed at outer surfaces of the first magnetic substrate 3, the stack body 7, the adhesive layer 8, and the second magnetic substrate 10.

As shown in FIG. 1B, the stack body 7 includes a plurality of layers evaporated by a thin film forming technique such as a sputtering. An insulating layer 6*a* formed of a non-magnetic insulation material such as a polyimide or epoxy resin is evaporated on the first magnetic substrate 3, leading electrodes 12*a* and 12*b* are formed on the insulating layer 6*a*, another insulating layer 6*b* is formed on the leading electrodes 12*a* and 12*b*, a coil pattern 4 and a leading electrode 12*c* extending from the coil pattern are formed on the insulating layer 6*b*, another insulating layer 6*c* is formed on the coil pattern 4 and the leading electrode 12*c*, and a coil pattern 5 and a leading electrode 12*d* extending from the coil pattern are formed on the insulating layer 6*c*.

One end of the coil pattern 4 is electrically connected to the leading electrode 12*a* through a via hole 13*a* formed on the insulating layer 6*b*, and the leading electrode 12*a* is electrically connected to the external electrode 11*a*. The other end of the coil pattern 4 is electrically connected to the external electrode 11*c* through the leading electrode 12*c*.

Meanwhile, one end of the coil pattern 5 is electrically connected to the leading electrode 12*b* through the via hole 13*c* formed on the insulating layer 6*c* and the via hole 13*b* formed on the insulating layer 6*b*, and the leading electrode 12*b* is connected to the external electrode 11*b*. The other end of the coil pattern 5 is electrically connected to the external electrode 11*d* through the leading electrode 12*d*.

In case of inserting said coil device to a circuit, each external electrode 11 is electrically connected to each connecting portion of the circuit, so that the coil patterns 4 and 5 are connected to the circuit.

Since said device is fabricated by a thin film forming technique such as a sputtering or an evaporation, an interval between the first and second coils can be small up to several $\mu$m. According to this, an electromagnetic coupling becomes greater than the conventional one and the device can become small, but an expensive equipment is required and a productivity is degraded.

Also, in the coil device of FIGS. 1A and 1B, the non-magnetic insulating layer 6*c* is positioned between the coil pattern 4 and the coil pattern 5. Accordingly, a leakage flux is generated thus to have a limitation in increasing an electromagnetic coupling and an impedance characteristic.

SUMMARY OF THE INVENTION

Therefore, an object of the present invention is to provide a stacked coil device having increased electromagnetic coupling and impedance characteristic.

Another object of the present invention is to fabricate a coil device having a high coupling coefficient and an enhanced insulating characteristic by a low cost process not by a thin film forming technique such as a sputtering and an evaporation.

To achieve these and other advantages in accordance with the purpose of the present invention, as embodied and broadly described herein, there is provided a stacked coil device comprising: an inner electrode layer formed of at least two layers and having a non-magnetic electrode layer and an inner magnetic layer as one unit, the non-magnetic electrode layer provided with an opening at a center thereof and provided with an electrode pattern on at least one surface of an upper surface and a lower surface thereof and the inner magnetic layer positioned at the center opening and a lateral surface of the non-magnetic electrode layer; a cover layer in contact with both surfaces of the inner electrode layer; and an external electrode terminal partially and electrically connected to the electrode pattern.

The inner electrode layer is preferably composed of a plurality of layers thus to make the electrode pattern formed on the non-magnetic electrode layer have a coil form of several layers. Herein, a via hole is formed on the non-magnetic electrode layer at a part where the electrode pattern is not formed and a conductive material is filled in the via hole, so that a part of the electrode pattern of the non-magnetic electrode layer where the via hole is formed is electrically connected to electrode patterns of another non-magnetic electrode layers in contact with upper and lower surfaces of the non-magnetic electrode layer through the via hole. The cover layer is formed of a magnetic layer, and a buffer layer composed of a non-magnetic layer or a magnetic layer having the same shape as the inner electrode layer and having no electrode pattern can be included between the cover layer and the inner electrode layer.

As a magnetic substance of the present invention, ferrite such as Ni-based, Ni—Zn based, Ni—Zn—Cu based material, and etc. can be used. Also, as a non-magnetic substance, $B_2O_3$—$SiO_2$ based glass, $Al_2O_3$—$SiO_2$ based glass, ceramic material having similar thermal expansion ratio to the ferrite are used.

A thickness of each layer constituting the coil device of the present invention is preferably formed to be thin.

To achieve these and other advantages and in accordance with the purpose of the present invention, as embodied and broadly described herein, there is also provided a fabrication method of a stacked coil device comprising: preparing green sheets that a magnetic film and a non-magnetic film are respectively formed on a carrier film; forming cutting lines on the magnetic film green sheet and the non-magnetic film green sheet; forming via holes on the non-magnetic film green sheet where the cutting lines are formed; forming an electrode pattern at an upper surface of the non-magnetic film green sheet where the via holes are formed; picking up unnecessary parts from the magnetic film green sheet and the non-magnetic film green sheet; stacking the green sheet where the magnetic film and the cutting lines are formed, and the green sheet where the non-magnetic film, the cutting lines, the via holes, and the electrode pattern are formed; firing the stack body; and forming an external electrode terminal at an outer surface of the fired stack body.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

FIGS. 2A to 2D are perspective views showing an appearance and an inner structure of a coil device according to the present invention.

Figure 1A:
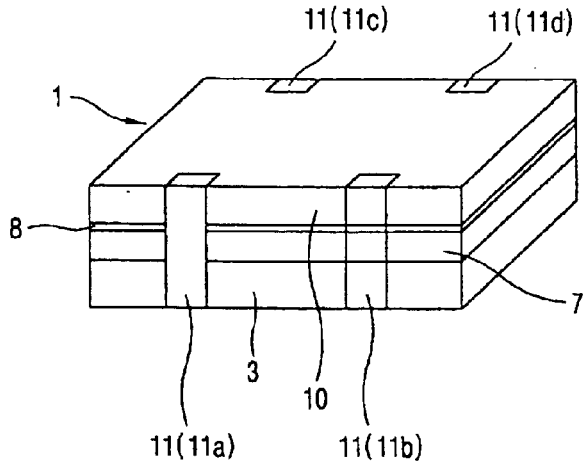
FIG. 1A BACKGROUND ART
FIG. 1A is a perspective view showing a coil device in accordance with the conventional art.
Figure 1B:
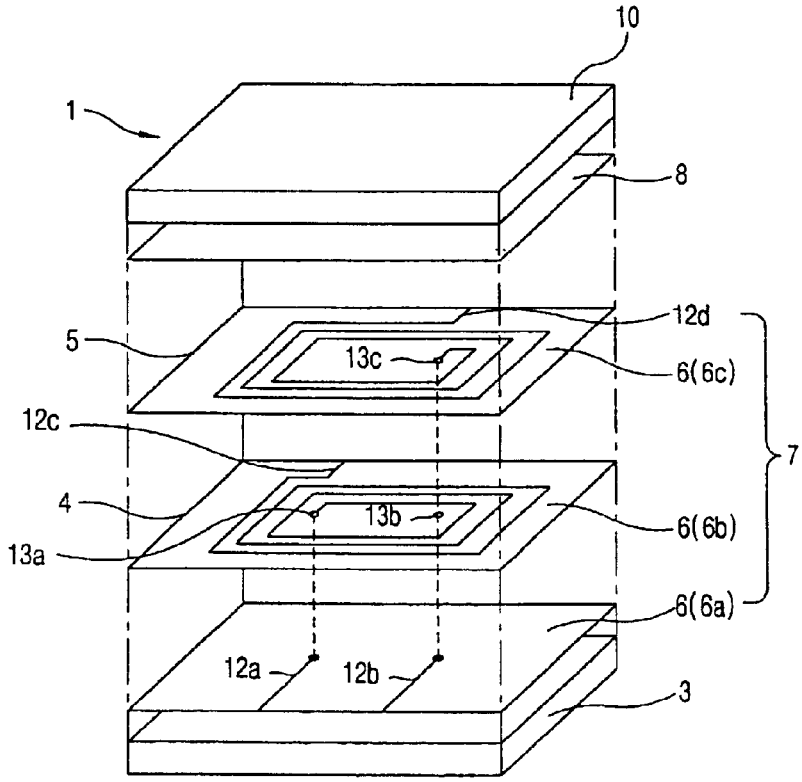
FIG. 1B BACKGROUND ART
FIG. 1B is a disassembled view of the coil device of FIG. 1A.
Figure 2A:
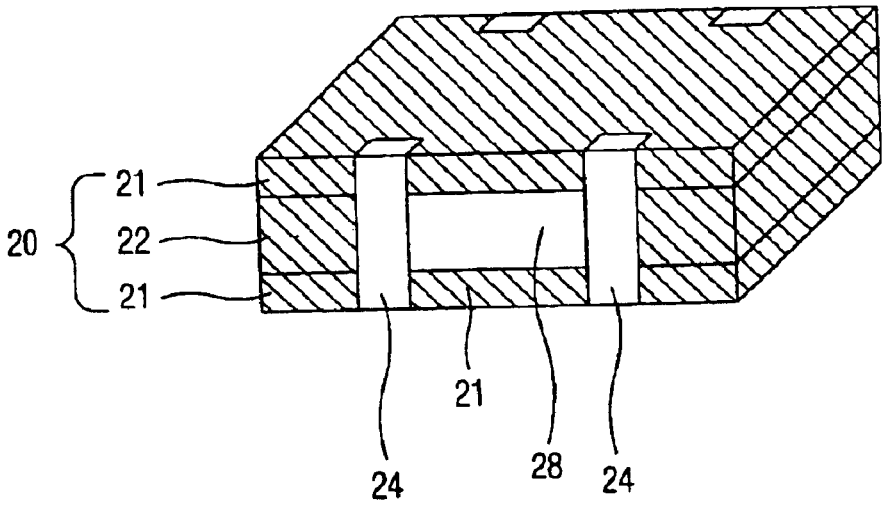
FIG. 2A is a perspective view showing an appearance of a coil device according to one embodiment of the present invention.

As shown in FIG. 2A, a cover layer 21 is formed at upper and lower surfaces of the coil device of a hexahedron shape, and an external electrode terminal 24 is formed at an outer circumference surface of a stack body 20. Also, a magnetic layer 22 and a non-magnetic layer 28 are positioned between the cover layers 21.

Figure 2B:
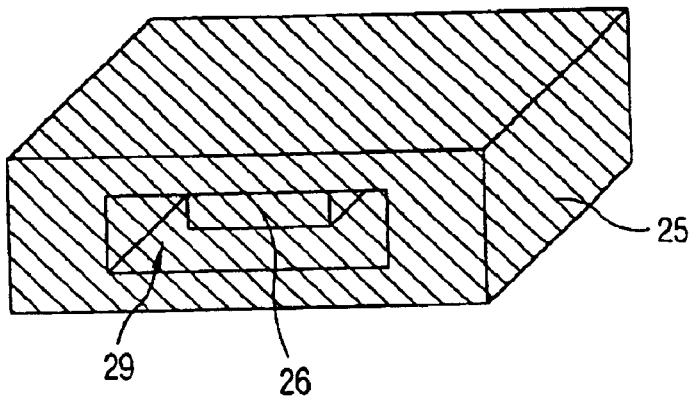
FIG. 2B is a perspective view showing an inner magnetic path of the coil device of FIG. 2A.

FIG. 2B shows only an inner magnetic layer in the coil device, in which a magnetic path can be shown. In FIG. 2A, a center magnetic layer 26 which was not shown since it was positioned at an inner center portion of the non-magnetic electrode layer can be shown. An inner space 29 formed by the center magnetic layer 26 and lateral magnetic layers 25 is occupied by the non-magnetic electrode layer. The center magnetic layer 26 and the lateral magnetic layers 25 can be formed by stacking several films, or can be formed as a bulk shape.

Figure 2C:
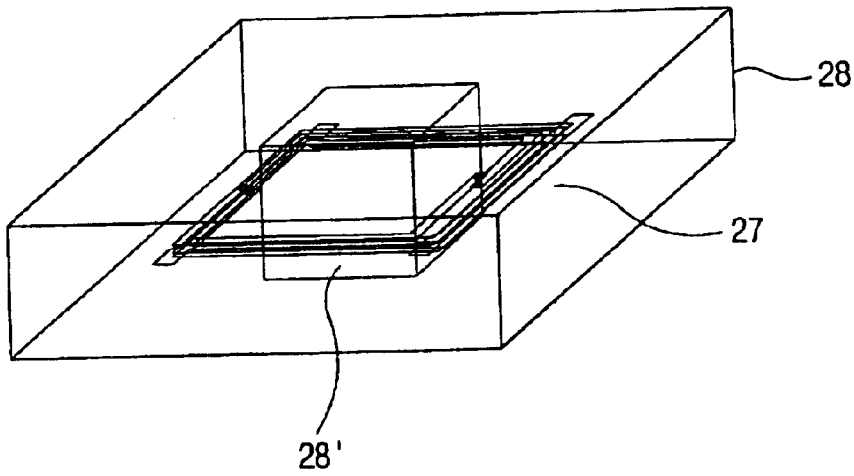
FIG. 2C is a perspective view showing an inner electrode pattern of the coil device of FIG. 2A.

FIG. 2C is a mimetic diagram showing the non-magnetic electrode layer 28, in which electrode patterns 27 are formed on each electrode layer as a coil shape and an empty space 28' where the center magnetic layer 26 is to be positioned is formed at an inner center portion. The electrode patterns can have a coil form with a constant interval up and down by the non-magnetic electrode layer 28, and the magnetic layer positioned at the inner center portion and each lateral surface and the electrode patterns can have an electromagnetic interaction. A form of the electrode patterns can be changed by various methods, and electrode patterns of each layer can be electrically connected to one another. Also, apart of the electrode patterns extend to outside thus to be electrically connected to the external electrode terminal.

Figure 2D:
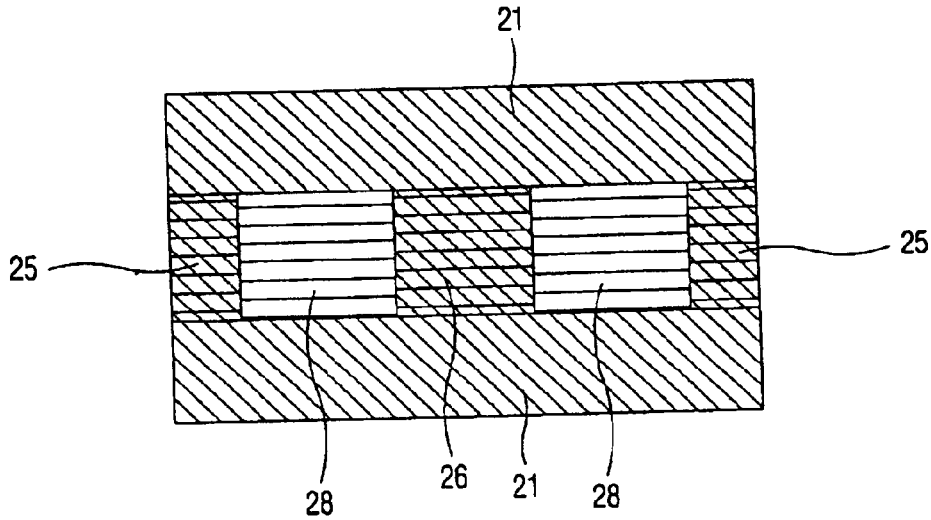
FIG. 2D is a sectional view showing an inside of the coil device of FIG. 2A.

FIG. 2D shows a sectional surface of the coil device of FIG. 2A, in which the center magnetic layer 26 and the lateral magnetic layers 25 are shown and the non-magnetic electrode layers 28 stacked with several layers are positioned between said two magnetic layers.

Figure 2E:
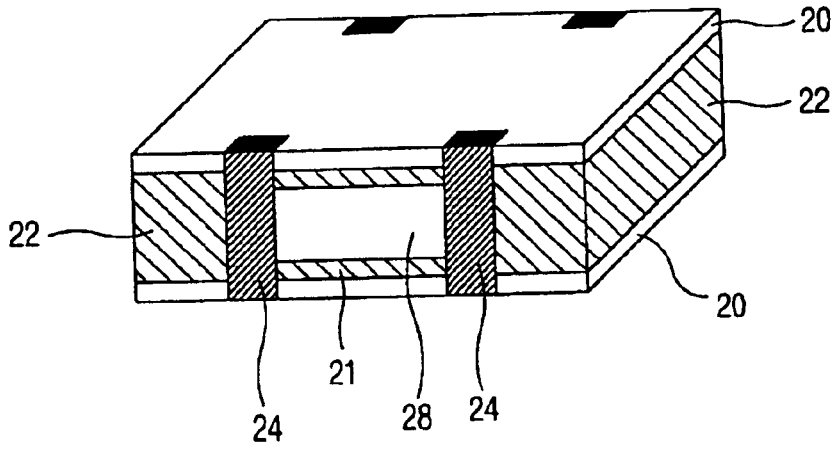
FIG. 2E is a perspective view showing an appearance of a coil device according to another embodiment of the present invention.

FIG. 2E is a perspective view showing another embodiment of the present invention, in which a cover layer 20 formed of a non-magnetic substance is additionally formed besides the cover layer 21 formed of a magnetic substance. The additional cover layer attenuates a minute difference of a thermal expansion ratio between the magnetic layer and the non-magnetic layer thus to stabilize a mechanical structure of the device.

The stacked coil device of the present invention is composed of the center magnetic layer 26, said two lateral magnetic layers 25, and the non-magnetic electrode layer 28 where the electrode patterns are formed thus to restrain a leakage flux generation and enhance its electromagnetic characteristics. Also, by using a non-magnetic layer of a high resistivity such as glass, an insulation resistance between the electrode patterns becomes great thus to obtain a stable insulation characteristic.

In the stacked coil device of the present invention, each layer is fabricated simply and economically and then sequentially stacked, thereby completing one single device. A fabrication method of the stacked coil device will be explained with reference to FIGS. 3A to 3F.

Figure 3A:
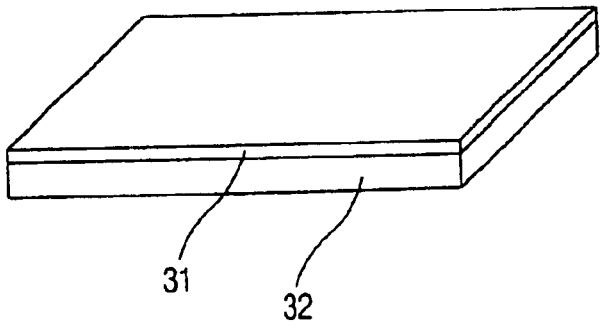
FIG. 3A is a perspective view showing a step of preparing a green sheet.

FIG. 3A shows a step of preparing a green sheet. On a carrier film 32, a magnetic film or a non-magnetic film 31 is formed. In the present invention, the magnetic film green sheet or the non-magnetic film green sheet are respectively formed by using a doctor blade tape casting method used in a thick film stacking process.

As the carrier film, a PET film is used and another materials can be used. The carrier film is picked up when each layer is sequentially stacked after a fabrication of each layer is completed.

The green sheet that the magnetic film or the non-magnetic film are formed on the carrier film 32 can be used as the cover layer by itself or by stacking several layers.

Figure 3B:
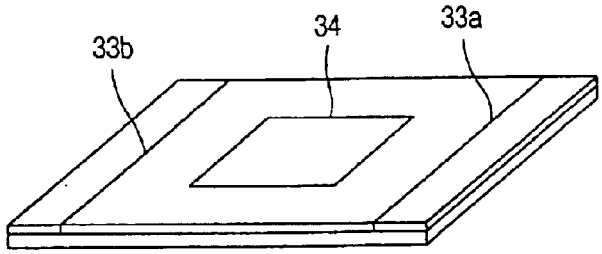
FIG. 3B is a perspective view showing a step of forming cutting lines.

After forming the green sheet, as shown in FIG. 3B, cutting lines are formed. The cutting lines are composed of an inner cutting line for an empty space 34 and both lateral cutting lines 33*a* and 33*b*. The cutting lines can be formed by a laser processing or a mechanical processing, in which the carrier film must not be damaged. A cutting processing of FIG. 3B is applied to both the magnetic film green sheet and the non-magnetic film green sheet.

The magnetic film green sheet or the non-magnetic film green sheet where the cutting lines are formed can be used as a buffer layer by itself or by stacking several layers.

Figure 3C:
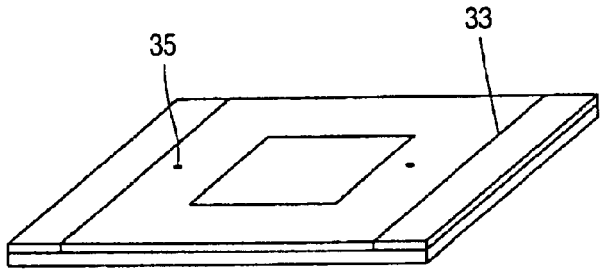
FIG. 3C is a perspective view showing a step of forming via holes.

As shown in FIG. 3C, on the non-magnetic film green sheet, not only the cutting line 33 but also via holes 35 are formed. The via holes are formed by using a laser punching or a mechanical punching.

Figure 3D:
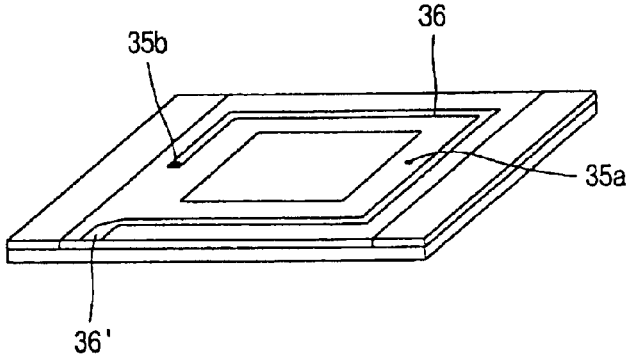
FIG. 3D is a perspective view showing a step of forming an electrode pattern.

As shown in FIG. 3D, in the non-magnetic green sheet where the cutting lines and the via holes are formed, an electrode pattern 36 is formed. The electrode pattern can be formed as different patterns (for example, a pattern that an electrode pattern of a first sheet and an electrode pattern of a second sheet are symmetrical to each other) by an order of the non-magnetic electrode layer, and can be varied into various shapes according to a usage purpose. Also, one end of the electrode pattern extends up to an end 36' of the green sheet thus to be electrically connected to an external electrode. A conductive paste is printed on an upper surface of the non-magnetic green sheet by using a screen printing method thus to form the electrode pattern, and a conductive material is filled in the via holes 35*a* and 35*b*. In FIG. 3D, one end of the electrode pattern is connected to the via hole 35*b* but the electrode pattern is not connected to another via hole 35*a*. This form is a means to electrically connect or not to connect each electrode pattern on the non-magnetic electrode layer by each layer.

Figure 3E:
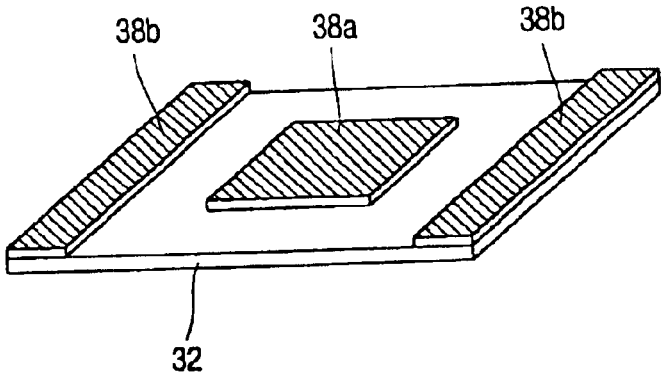
FIG. 3E is a perspective view showing a magnetic layer in a state that a pick up has been finished.
Figure 3F:
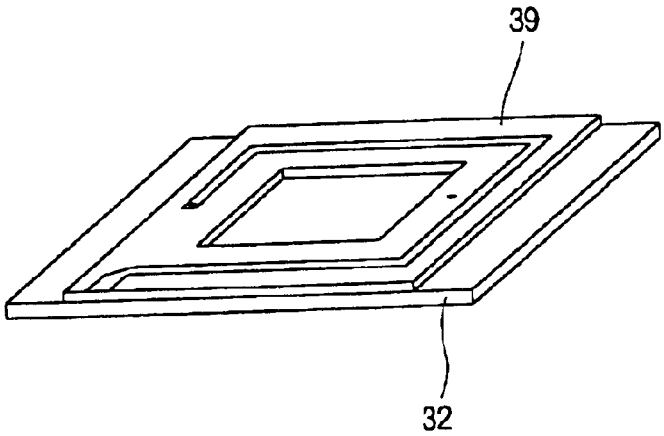
FIG. 3F is a perspective view showing a non-magnetic layer in a state that a pick up has been finished.

Unnecessary parts of the magnetic green sheet where the cutting lines are formed and the non-magnetic green sheet where the electrode patterns are formed are picked-up. At this time, picked-up regions of the magnetic green sheet and the non-magnetic green sheet are opposite to each other thus to constitute one single layer of the magnetic green sheet and the non-magnetic green sheet. FIGS. 3E and 3F show the magnetic and non-magnetic green sheets where unnecessary parts are picked up. In FIG. 3E, only a center region 38*a* and a periphery region 38*b* of the magnetic green sheet remain, and in FIG. 3F, a non-magnetic layer 39 of the non-magnetic green sheet remains only at a region opposite to that of the magnetic green sheet.

Figure 4A:
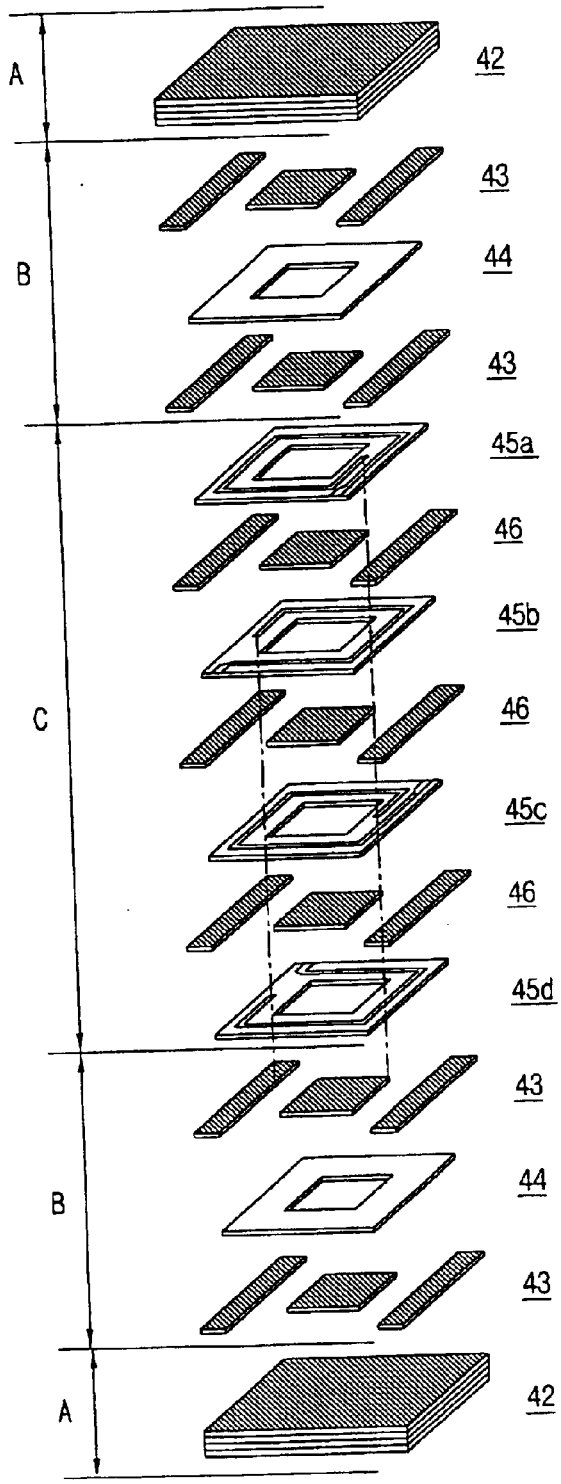
FIG. 4A is a flow chart showing a step of stacking.

Once a fabrication of each layer is finished, each layer is sequentially stacked. FIG. 4A shows a stack processing, in which each layer is sequentially stacked as one. A denotes a cover layer, B denotes a buffer layer, and C denotes an electrode layer. The cover layer is composed of a magnetic layer 42, but can be composed of a magnetic layer and a non-magnetic layer as another embodiment. The buffer layer B is composed of a magnetic layer 43 and a non-magnetic layer 44, and prevents electrode patterns of non-magnetic layers 45*a* and 45*d* from being in directly contact with the upper and lower cover layers. The green sheet fabricated in FIGS. 3A and 3B and the green sheet where the cutting lines are formed are used as the cover layer and the buffer layer in a state that the carrier film is respectively picked-up.

The magnetic films 38*a* and 38*b* fabricated in FIG. 3E and the non-magnetic film 39 in FIG. 3F are alternately stacked thus to form an electrode layer. Even though the electrode layer is composed of four layers in FIGS. 4A and 4B, more layers are preferably stacked.

Figure 4B:
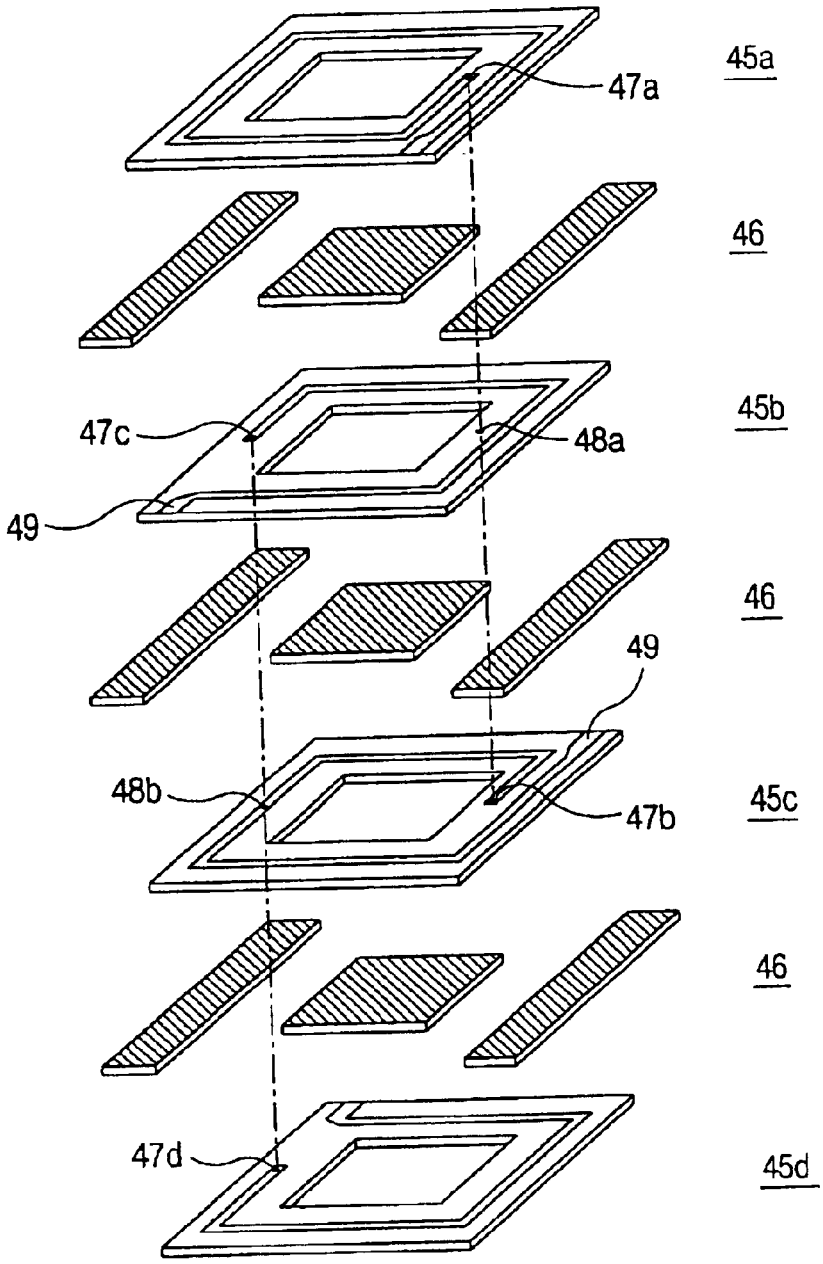
FIG. 4B is a flow chart showing an electrode layer of FIG. 4A by enlargement.
Figure 4C:
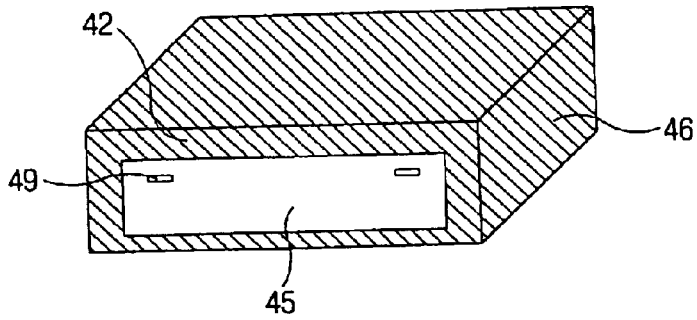
FIG. 4C is a perspective view showing an appearance of a coil device in a state that a stacking has been finished.

FIG. 4B shows an example that the electrode layer is composed of several layers, in which magnetic layers 46 and non-magnetic layers 45*a* to 45*d* are alternately stacked and thus exist in the same layer. By this stack, the electrode patterns formed on the non-magnetic layer are electrically connected to each other. Herein, one end of the electrode pattern (47*a* or 47*c*) is connected to a via hole (48*a* or 48*b*) thus to be electrically connected to another end of the electrode pattern of another layer (47*b* or 47*d*). Another end of the electrode pattern 49 extends up to an edge of the non-magnetic layer for an external electrical contact, and an external electrode terminal is formed at the end 49 after the stack. FIG. 4C shows a state that the stack has been finished.

When the inner electrode pattern, the non-magnetic substance, and the magnetic substance are simultaneously fired by firing the stack body after stacking, an electrode pattern of a coil form, an insulating region of a non-magnetic substance, and a magnetic path of a magnetic substance are formed.

After the firing process, an external electrode terminal is formed at a lateral surface of the stack body by using a dipping or a roller.

By said fabrication process, the stacked coil device of the present invention can be economically fabricated and a large amount of devices can be fabricated fast.

Figure 5A:
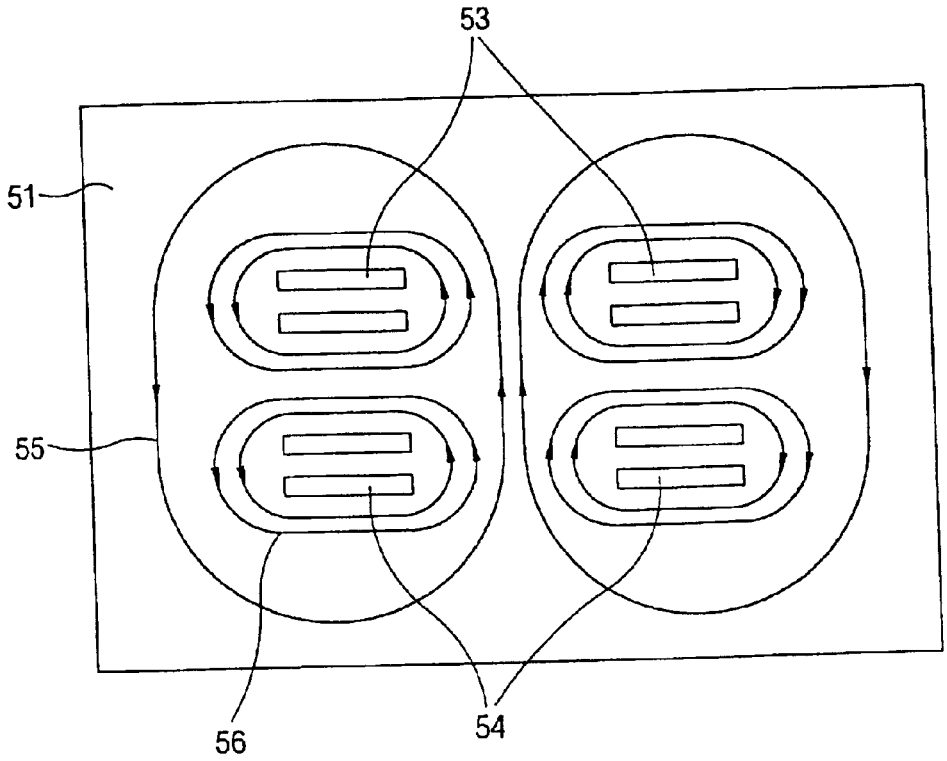
FIG. 5A is a sectional mimetic diagram showing a magnetic field of a coil device composed of only a magnetic substance.
Figure 5B:
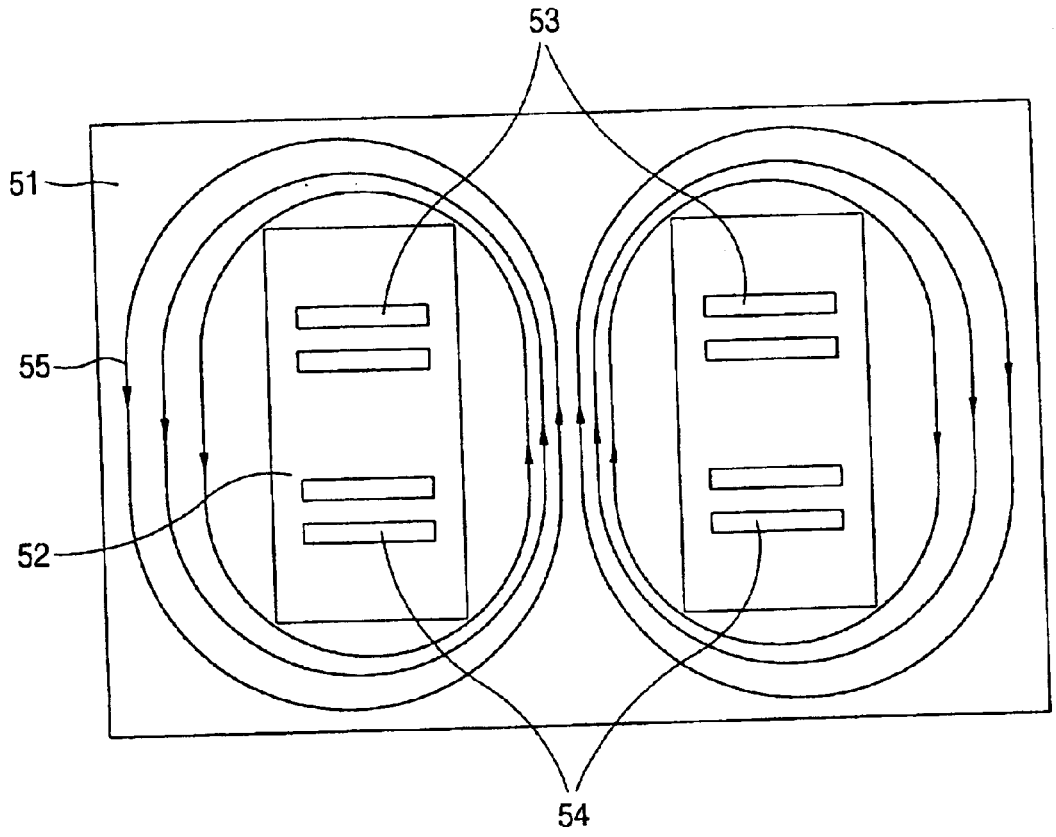
FIG. 5B is a sectional mimetic diagram showing a magnetic field of a coil device of the present invention.

FIGS. 5A and 5B mimetically show magnetic fields of a coil device formed of only a magnetic substance and a coil device formed of a magnetic substance and a non-magnetic substance. As shown in FIG. 5A, in case that the coil device is formed of only a magnetic substance, both a first coil 53 and a second coil 54 are formed in a magnetic substance 51 having a high magnetic permeability. According to this, a part of the magnetic field generated from the first coil is not transmitted to the second coil but leaks to a periphery of the first coil. The reference number 55 denotes an effective magnetic field used in an electromagnetic coupling between the first and second coils, and the number 56 denotes a leakage magnetic field. By the leakage magnetic field, a coupling coefficient of the coil device is lowered and thus a function thereof is degraded when used as a common mode filter or a transformer. On the contrary, in case of the coil device of the present invention, both the first coil 53 and the second coil 54 exist in a non-magnetic substance 52 having a low magnetic permeability, so that a leakage magnetic field between the coils is not generated. Thus, a magnetic filed generated from the first coil can be transmitted to the second coil without a loss. That is, a coupling coefficient, a ratio between a common mode ingredient and a normal mode ingredient of an impedance, becomes great.

A following table 1 shows a comparison of coupling coefficients of the coil device of the present invention and another devices of the conventional art.

TABLE 1

| | coupling coefficient (%) |
|---|---|
| magnetic/non-magnetic type | 98.82 |
| magnetic type | 85.89 |
| winding type | 96.02 |

The winding type means a general coil device that a conducting wire is wound on a magnetic substance, the magnetic/non-magnetic type means the coil device of the present invention, and the magnetic type means a coil device shown in FIG. 5A. From the table 1, it can be seen that the coupling coefficient of the coil device according to the present invention is much more excellent than the coupling coefficients of another types.

As aforementioned, in the present invention, the stacked coil device having improved electromagnetic coupling and impedance characteristic and an excellent insulating characteristic between the coil patterns can be fabricated. Also, the coil device can be fabricated by a low cost processing not by a thin film forming technique such as a sputtering or an evaporation, thereby enhancing a productivity.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A stacked coil device comprising:

at least two layers of an inner electrode part having a non-magnetic electrode region and an inner magnetic region assembled as one layer, said non-magnetic electrode region being provided with an opening at a center thereof and with an electrode pattern on at least one of upper and lower surfaces thereof, and said inner magnetic region being positioned at the opening and at lateral sides of the non-magnetic electrode region;

a cover layer in contact with both surfaces of the inner electrode part; and an external electrode terminal electrically connected to a part of the electrode pattern.

2. The device of claim 1, wherein a first via hole is formed on the non-magnetic electrode region at a part where the electrode pattern is not formed, a second via hole is formed on the electrode pattern, and a conductive material is filled in the via holes.

3. The device of claim 2, wherein a part of the electrode pattern of the non-magnetic electrode region where the via holes are formed is electrically connected to electrode patterns of another non-magnetic electrode region in contact with upper and lower surfaces of the non-magnetic electrode region through the via holes.

4. The device of claim 1, wherein the cover layer further includes an inner electrode layer.

5. The device of claim 1, further comprising a buffer layer composed of a non-magnetic layer or a magnetic layer having the same shape as the inner electrode layer and having no electrode pattern between the cover layer and the inner electrode layer.

6. The device of claim 1, wherein the non-magnetic electrode region is composed of $B_2O_3$—$SiO_2$ based glass, $Al_2O_3$—$SiO_2$ based glass, or ceramic material having similar thermal expansion ratio to the ferrite.

7. The device of claim 1, wherein the inner magnetic region is composed of ferrite such as Ni-based material, Ni—Zn based material, Ni—Zn—Cu based material, and etc.

8. A fabrication method of a stacked coil device comprising:

preparing a magnetic film green sheet that a magnetic film is formed on a carrier film and a non-magnetic film green sheet that a non-magnetic film is formed on a carrier film;

forming cutting lines on the magnetic film green sheet and forming an opening in the non-magnetic film green sheet;

forming via holes on the non-magnetic film green sheet;

forming an electrode pattern at an upper surface of the non-magnetic film green sheet;

picking up unnecessary parts from the magnetic film green sheet and the non-magnetic film green sheet;

stacking the green sheet where the magnetic film and the cutting lines are formed, and the green sheet where the non-magnetic film, the opening, the via holes, and the electrode pattern are formed wherein pick-up regions of the magnetic film green sheet and the non-magnetic film green sheet are opposite to each other thus to constitute one single layer of a magnetic region and a non-magnetic region;

firing the stacked body; and forming an external electrode terminal at an outer surface of the fired stack body.

9. The method of claim 8, wherein the magnetic green sheet or the non-magnetic green sheet on the carrier film are respectively formed by using a doctor blade tape casting method.

10. The method of claim 8, wherein the electrode pattern of an upper surface of the non-magnetic region is formed by a screen printing.

* * * * *